US005582346A

United States Patent [19]

Wakui et al.

[11] Patent Number: 5,582,346

[45] Date of Patent: Dec. 10, 1996

[54] LADDER-TYPE SLEEPERS AND RAILWAY TRACKS

[75] Inventors: Hajime Wakui; Nobuyuki Matsumoto; Hiromi Inoue, all of Tokyo, Japan

[73] Assignee: Railway Technical Research Institute, Tokyo, Japan

[21] Appl. No.: 609,484

[22] Filed: Mar. 1, 1996

Related U.S. Application Data

[63] Continuation of Ser. No. 406,748, Mar. 20, 1995, abandoned.

[30] Foreign Application Priority Data

Mar. 29, 1994 [JP] Japan ..... 6-082475

[51] Int. Cl.[6] ..... E01B 3/00

[52] U.S. Cl. ..... 238/25

[58] Field of Search ..... 238/24, 25, 26

[56] References Cited

U.S. PATENT DOCUMENTS

| | | | |
|---|---|---|---|
| 681,567 | 8/1901 | McDermott | 238/26 |
| 755,810 | 3/1904 | Swigart | 238/24 |
| 879,592 | 9/1908 | Cooper | 238/26 |
| 904,418 | 11/1908 | Franklin | 238/24 |
| 1,682,665 | 8/1928 | Day | 238/25 |
| 1,682,666 | 8/1928 | Day | 238/25 |
| 2,620,137 | 12/1952 | Gilmer | 238/24 |
| 3,300,140 | 1/1967 | Moses et al. | 238/25 |

FOREIGN PATENT DOCUMENTS

| | | |
|---|---|---|
| 434496 | 9/1911 | France . |
| 2359245 | 7/1976 | France . |
| 1017197 | 10/1957 | Germany . |
| 1020665 | 12/1957 | Germany . |
| 133809 | 11/1979 | United Kingdom . |

OTHER PUBLICATIONS

European Search Report on EP 95 40 0641 dated Jun. 27, 1995.

*Primary Examiner*—Mark T. Le

*Attorney, Agent, or Firm*—Finnegan, Henderson, Farabow, Garrett & Dunner, L.L.P.

[57] ABSTRACT

The present invention comprises longitudinal beams provided on the underside of each of a pair of rails in the longitudinal direction of the rails and multiple connectors which mutually connect these longitudinal beams at designated spacings along the longitudinal direction. Because the ladder-type sleepers of the present invention have a structure wherein longitudinal beams are continuously positioned along the longitudinal direction of the rails, the bending stiffness of the track frame in the longitudinal direction increases, and the ballast pressure is reduced by improving the distribution of the train load. As a result, it is possible to reduce track irregularities resulting from the repeated burden of the train load.

28 Claims, 7 Drawing Sheets

PRIOR ART

VERTICAL PRESSURE DISTRIBUTION BENEATH CROSS SLEEPERS

VERTICAL PRESSURE DISTRIBUTION BENEATH LADDER-TYPE SLEEPERS

LADDER-TYPE SLEEPERS AND RAILWAY TRACKS

This application is a continuation of application Ser. No. 08/406,748, filed Mar. 20, 1995, now abandoned.

FIELD OF THE INVENTION

The present invention relates to railway tracks and sleepers used for these railway tracks.

BACKGROUND ART

FIG. 16 is a compositional diagram of a conventional ballasted track which uses cross-sleepers. In the diagram, 4 is a rail, 6 is ballast, 7 is a rail fastening, and 8 is a cross-sleeper. Conventional ballasted tracks have a structure wherein the track frame is comprised of mono-block or twin-block cross-sleepers 8 which are placed transversely with respect to the rails. The train load and the loads in the longitudinal direction of the rails and in the transverse direction of the rails are supported by the beating pressure and friction of the ballast 6.

The above-mentioned conventional tracks using cross-sleepers have a tendency to form track irregularities since they are subjected to the severe effect of repeated train loads. As a result, such irregularities increase the severity of train vibrations, deteriorating the running stability and the ride comfort. For this reason, maintenance work is regularly required to accurately measure the condition of track irregularity, and to align or repair the places where track irregularities are formed, whenever such repair is needed.

However, the required labor and expenses are enormous, not only because such maintenance and repair are still dependent upon manual labor, but especially because such work is often done at night and needs to be completed within a short time. Furthermore, labor shortages and the aging of such maintenance workers have become problems. Therefore, a track structure is desired which can reduce the amount of required maintenance work.

With conventional tracks using cross-sleepers, not only does the ballast pressure become large in localized areas due to the intermittent support provided to the rails, but also the repeated loads with respect to the wheels due to the passage of trains form track irregularities. When these track irregularities become large, the severity of the train vibrations increase, and the running stability and ride comfort deteriorate. For this reason, there is the problem that regular maintenance work is required.

Additionally, French Patent No. 76-22586 teaches the use of short sleepers which are placed parallel to the rails. Even with these types of sleepers, however, solutions are still necessary to problems such as how to maintain the track geometry, and how to make the ballast pressure uniform along the longitudinal direction of the rails.

The ladder-type sleepers of the present invention are offered as a solution to the above-mentioned problems. These ladder-type sleepers aim to reduce the amount of maintenance work required by (1) decreasing track irregularities due to repeated train loads by improving the distribution of the train load, and (2) decreasing track irregularities due to loads in the transverse direction of the rails, such as lateral thrust, by taking advantage of the high transverse resistance provided by continuous longitudinal sleepers. A further objective of the ladder-type sleepers of the present invention is the presentation of a railway track made by coupling these sleepers to rails. By adopting a continuous beam structure in the direction parallel to the rails, and by placing continuous rail pads which continuously support the rails, the ladder-type sleepers of the present invention make it possible to reduce ground vibrations, rolling noise, and corrugation of the rails.

SUMMARY OF THE INVENTION

In order to realize the above-mentioned objectives, the present invention comprises longitudinal beams provided on the underside of each of a pair of rails in the longitudinal direction of said rails and multiple connectors which mutually connect these longitudinal beams at designated spacings along the longitudinal direction. Said connectors are characterized in that they are more flexible than said longitudinal beams.

The present invention is characterized by the following points in addition to the those mentioned above.

Said longitudinal beams and the rails are coupled at a plurality of points along the longitudinal direction of the rails.

Said connectors have a circular cross-section.

Anti-creep panels, for increasing the resistance of the sleepers to loads in the longitudinal direction, and having approximately the same height as said longitudinal beams, are provided between the longitudinal beams.

On the inside surfaces of said longitudinal beams, grooves for inserting the end portions of said anti-creep panels are provided in the vertical direction.

Said longitudinal beams comprise prestressed concrete, and said connectors are made long enough to reach both outside portions of the longitudinal beams, intersecting with prestressing strands embedded in said longitudinal beams.

Said longitudinal beams are placed on a bed comprising ballast, cement-asphalt mortar, rubber, or synthetic resin, and any combination thereof.

The longitudinal beams which repeat in the longitudinal direction are bound together.

The cross-sectional areas of said longitudinal beams are set at the appropriate minimum cross-sections allowed based on the embedding depth, concrete cover, and distances between pairs of fastening means for coupling the rails to the longitudinal beams.

The railway tracks of the present invention comprise longitudinal beams provided on the underside of each of a pair of rails in the longitudinal direction of said rails and multiple connectors which mutually couple these longitudinal beams with a designated spacing along the longitudinal direction. Said connectors are more flexible than said longitudinal beams, and said longitudinal beams are coupled to said rails at a plurality of points along the longitudinal direction of the rails.

Because the ladder-type sleepers of the present invention have a structure wherein longitudinal beams are continuously positioned along the longitudinal direction of the rails, the bending stiffness of the track frame about the transverse axis increases, and the ballast pressure is reduced by improving the distribution of the train load. As a result, it is possible to reduce track irregularities resulting from the repeated burden of the train load. Furthermore, it is possible to make the ladder-type sleepers with approximately the same volume of concrete per unit length in the longitudinal direction as is needed for monoblock-type sleepers.

By using slender connectors such as steel pipes or angular steel pipes, the connectors receive only a small reaction force from the ballast. As a result, the track stiffness along the longitudinal direction only fluctuates slightly, and bending or torsional stresses imposed on the connectors due to an unbalance in the bearing force of the ballast can be largely reduced. Furthermore, by using slender connectors, it becomes possible to insert them between the prestressing strands which are the main reinforcements of the longitudinal beams, and to firmly embed them in between the rail fasteners.

The sleepers of the present invention can be used with beds of ballast, cement-asphalt mortar, rubber, or synthetic resin, and combinations thereof.

By mutually binding longitudinal beams which are adjacent in the longitudinal direction, a repeated track structure is realized wherein the track stiffness is uniform over long distances.

Because the longitudinal beams are placed in the longitudinal direction of the rails, continuous support of the rails by the continuous laying of rail pads becomes possible, so that ground vibrations, rolling noise, and corrugation of the rails can be reduced.

In cases in which the resistance of the sleepers in the longitudinal direction is insufficient when they are subjected to longitudinal forces in the movable sections of long welded rails, it is possible to resist the longitudinal load by providing anti-creep panels.

If track irregularities are formed, the sleepers are able to be lifted by a maintenance machine at arbitrary points, and track maintenance work such as tamping the ballast, blowing in fine crushed stone, or mortar injection can be performed.

With an overall structure in which the ladder-type sleepers are coupled with the rails, a relatively high bending stiffness of the track frame can be realized.

As explained above, with the use of the ladder-type sleepers of the present invention, because of the structure wherein the longitudinal beams are provided along the longitudinal direction of the rails, the bending stiffness of the track frame about the transverse axis is increased, the distribution of the train load is improved so that track irregularities resulting from repeated loads are reduced, and thus less maintenance work is required. Additionally, in the transverse direction, because the longitudinal beams increase the transverse resistance force, track irregularities are reduced as in the vertical direction, and consequently, less maintenance work is required.

Furthermore, by mutually binding the longitudinal beams in a repeating fashion along the longitudinal direction similar to long welded rails, track deterioration at the end portions of the longitudinal beams may be prevented. Additionally, by continuously placing rail pads, it is possible to reduce ground vibrations, rolling noise and corrugation of the rails.

As a result, the amount of work required for track maintenance is reduced, and the problems of labor shortages and aging of track maintenance workers are able to be overcome. Additionally, by using cement-asphalt mortar, rubber, synthetic resin, or the like as an alternative to ballast, it is possible to reduce the costs of materials and construction of conventional non-ballasted tracks.

Additionally, because the structure is designed such that anti-creep panels are able to be inserted into grooves formed on the inside surfaces of the longitudinal beams, by inserting these anti-creep panels into said grooves as necessary, the resistance force in the longitudinal direction is increased, without affecting the structural properties of the ladder-type sleepers.

DETAILED DESCRIPTION OF THE PREFERRED EMBODIMENTS

Figure 1:
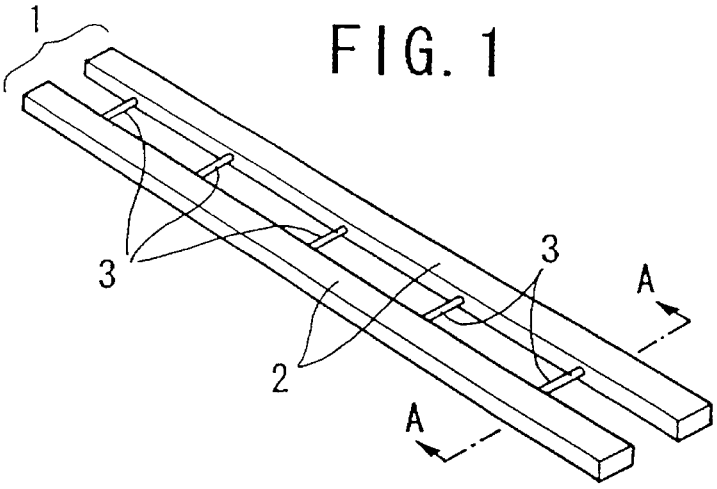
FIG. 1 Compositional diagram of the ladder-type sleepers of Embodiment 1 of the present invention.
Figure 2:
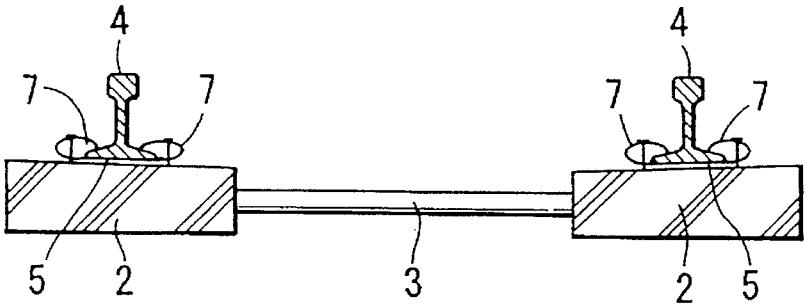
FIG. 2 Cross-sectional view of the cross-section along A—A of FIG. 1.

FIG. 1 is a compositional diagram showing Embodiment 1 of the present invention. FIG. 2 is a cross-sectional view cut along A—A in FIG. 1. FIG. 3 is a schematic diagram showing the state of distribution of ballast pressure for the ladder-type sleeper track structure of Embodiment 1 and the state of distribution of ballast pressure for a conventional cross-sleeper-type track structure. In the diagrams, 1 is a ladder-type sleeper, 2 is a longitudinal beam, 3 is a connector coupling longitudinal beams 2, 4 is a rail, 5 is a rail pad (for example, an elastic material made from rubber sheets) which is put between the rail 4 and the longitudinal beam 2 and absorbs vibrations, 6 is ballast in which the ladder-type sleepers are embedded, 7 is a rail fastening for coupling the rail 4 to the longitudinal beam 2, 8 is a conventional cross-sleeper, and 10 is a wheel.

The ladder-type sleepers 1 of the present embodiment comprise pairs of longitudinal beams 2, having a bending stiffness which allows the employment of conventional track maintenance methods, and slender and durable connectors 3, connecting the longitudinal beams 2, which are installed at designated spacings along the longitudinal direction. In order to provide an appropriate bending stiffness for the longitudinal beams 2, their cross-sections are made comparatively low in height. Additionally, the longitudinal beams 2 support rails 4 which are coupled to their upper surfaces. By distributing the train load, they reduce track irregularities produced by the burden of repeated train loads. The connectors 3 couple the pairs of longitudinal beams 2 and thereby function to maintain the rail gauge.

With conventional cross-sleeper tracks, the sleepers are merely bearing points for the rails. The bending stiffness about the transverse axis of the track frame depends only on the rails 4. As a result, deformations of the rails 4 due to the train load are large, causing relatively severe train vibrations. In contrast, since the ladder-type sleepers 1 have longitudinal beams 2 continuing in the longitudinal direction of the rails, they have the combined stiffness of the longitudinal beams 2 and the rails 4. Therefore, the bending stiffness of the track frame about the transverse axis is increased so that the train load is distributed, and the vertical pressure in the ballast per unit area is reduced.

Since the longitudinal beams 2 are continuously embedded in the longitudinal direction, the transverse resistance in the ballast 6 is large, and track irregularities are able to be reduced.

Figure 3A:
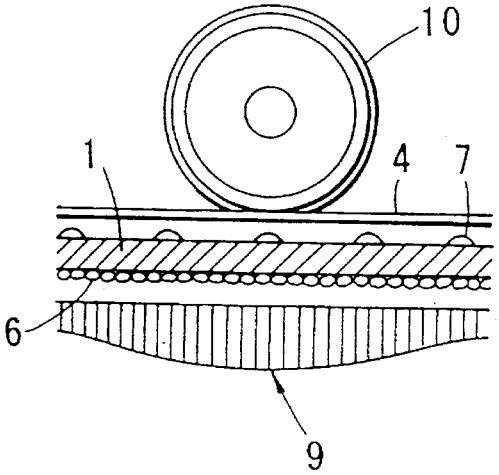
FIG. 3A Schematic diagram showing the state of distribution of ballast pressure for the ladder-type sleeper track structure of Embodiment 1.
Figure 3B:
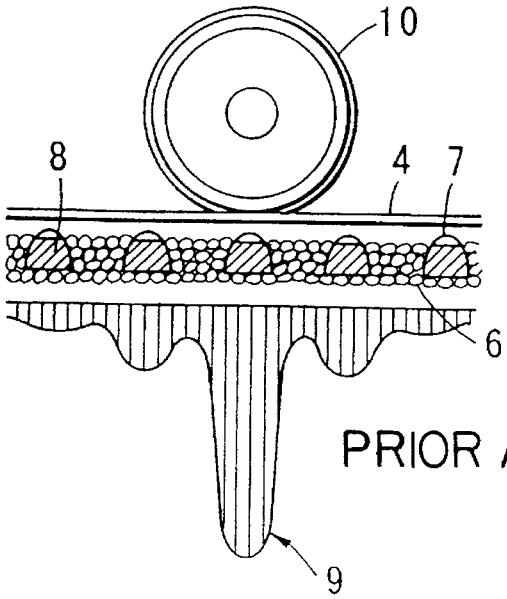
FIG. 3B Schematic diagram showing the state of distribution of ballast pressure for a conventional cross-sleeper-type track structure.

FIGS. 3A and 3B show schematic diagrams of the pressure distribution 9 in the ballast underneath the sleepers when a load in the downwards direction is applied by the passage of a train from the wheels 10 to the rails 4 and the sleepers 1 and 8 directly below. In the case of the ladder-type sleepers 1, as shown in FIG. 3A, since the load from the wheels 10 is supported by the combination of the longitudinal beams 2 and the rails 4, the load becomes less concentrated in the portions directly under the wheel 10. In contrast, with the conventional 8, as shown in FIG. 3B, the load is concentrated at the sleeper 8 directly under the wheels 10. Consequently, a localized increase in the ballast pressure is apparent.

By using ladder-type sleepers, the maximum value of the ballast pressure is decreased, and fluctuations in the ballast pressure are dampened. Additionally, accelerations of the ballast which are caused by the passage of trains decrease markedly. As a result, it becomes possible to prevent deterioration or irregularity of the tracks due to ballast wear or ballast flow.

Figure 4A:
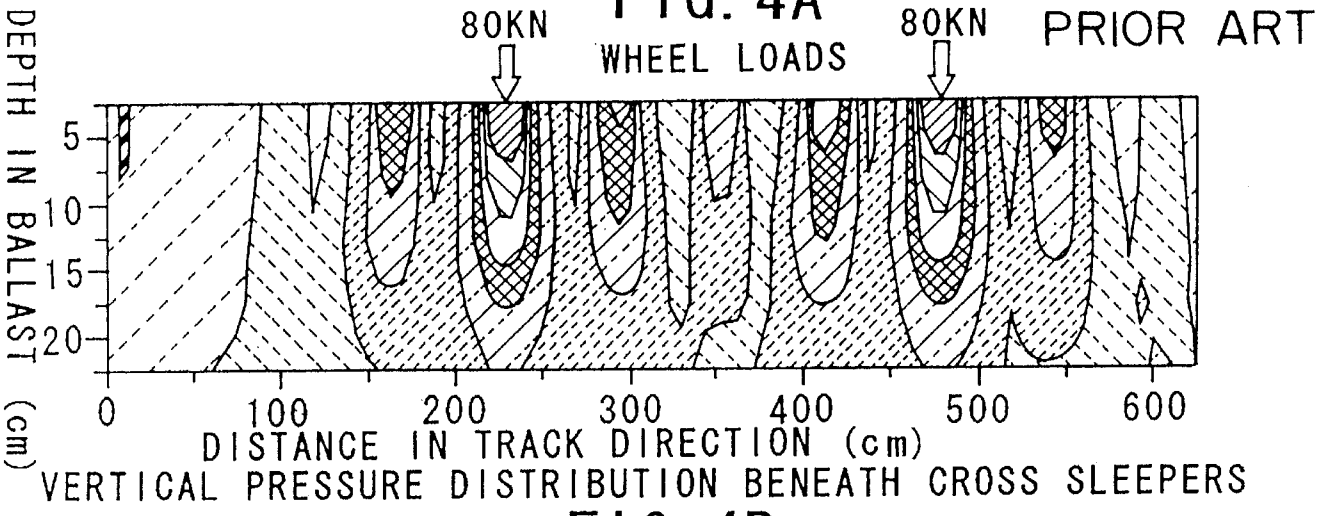
FIG. 4A Plots showing the state of distribution of ballast pressure for the ladder-type sleeper track structure of Embodiment 1, according to an analysis.
Figure 4B:
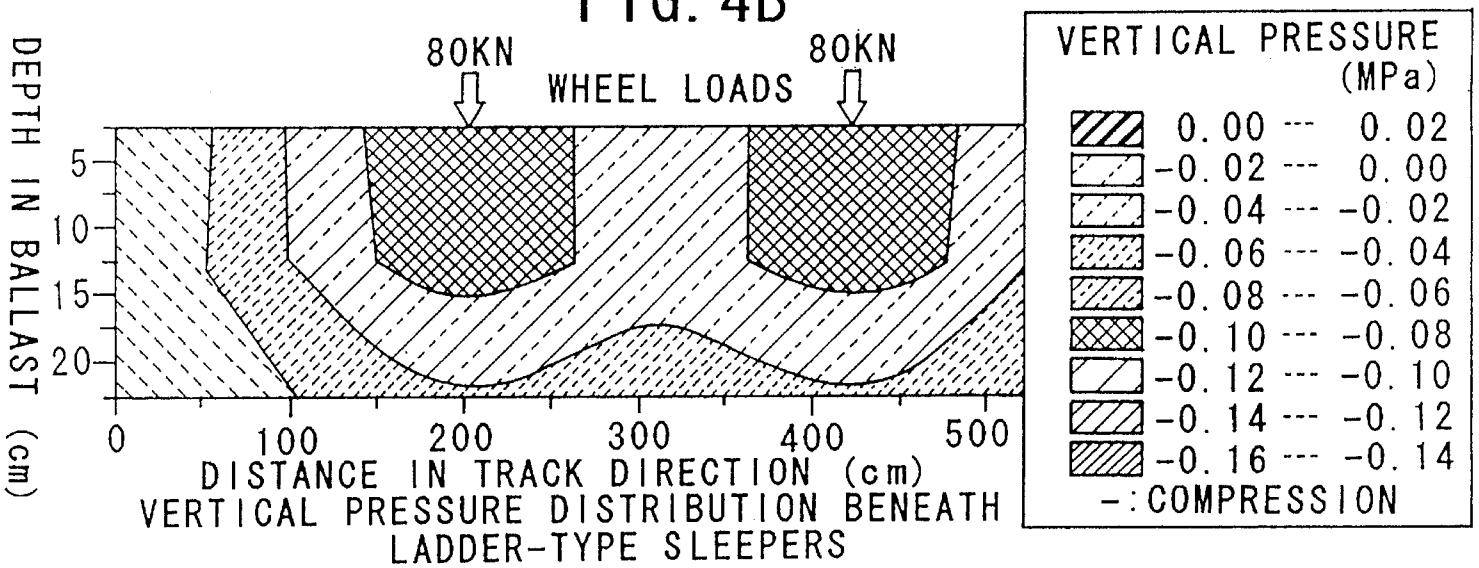
FIG. 4B Plots showing the state of distribution of ballast pressure for a conventional cross-sleeper-type track structure, according to an analysis.

Furthermore, FIGS. 4A and 4B show the results of an analysis wherein the distribution of the pressure generated in the ballast due to wheel loads applied in the directions indicated by the arrows was calculated with respect to the longitudinal and downwards directions. If a wheel load of 80 kN is applied, an extreme increase in the pressure directly underneath the wheels is apparent for the conventional cross-sleepers. In contrast, for the ladder-type sleepers, as shown in FIG. 4B, it was confirmed that there were no localized pressure increases. Furthermore, regarding the maximum pressure value within the ballast, it was confirmed that the ladder-type sleepers of the present invention have a value which is approximately half that of conventional cross-sleepers.

Figure 5:
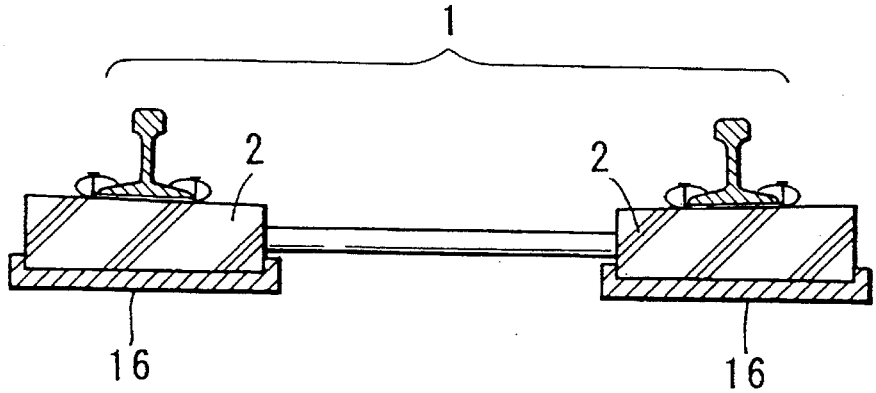
FIG. 5 Compositional diagram showing Embodiment 2 of the present invention, wherein cement-asphalt mortar is used as the bed material.

FIG. 5 is a compositional diagram showing Embodiment 2 of the present invention, wherein cement-asphalt mortar is used as the bed material. In this case, 1 is a ladder-type sleeper, 2 is a longitudinal beam, and 16 is a bed comprising cement-asphalt mortar.

Unlike ballast beds in which non-uniformities in the supporting strength easily arise, with beds comprising cement-asphalt mortar, rubber, synthetic resin and the like, non-uniformities in the supporting strength rarely arise. With this Embodiment 2, as a substitute for track slabs or large panel sleepers (wide sleepers), the ladder-type sleepers of the present invention can be placed on a bed 16 comprising cement-asphalt mortar. Similarly, the ladder-type sleepers of the present invention can be placed on beds comprising rubber or synthetic resin as well.

Figure 6:
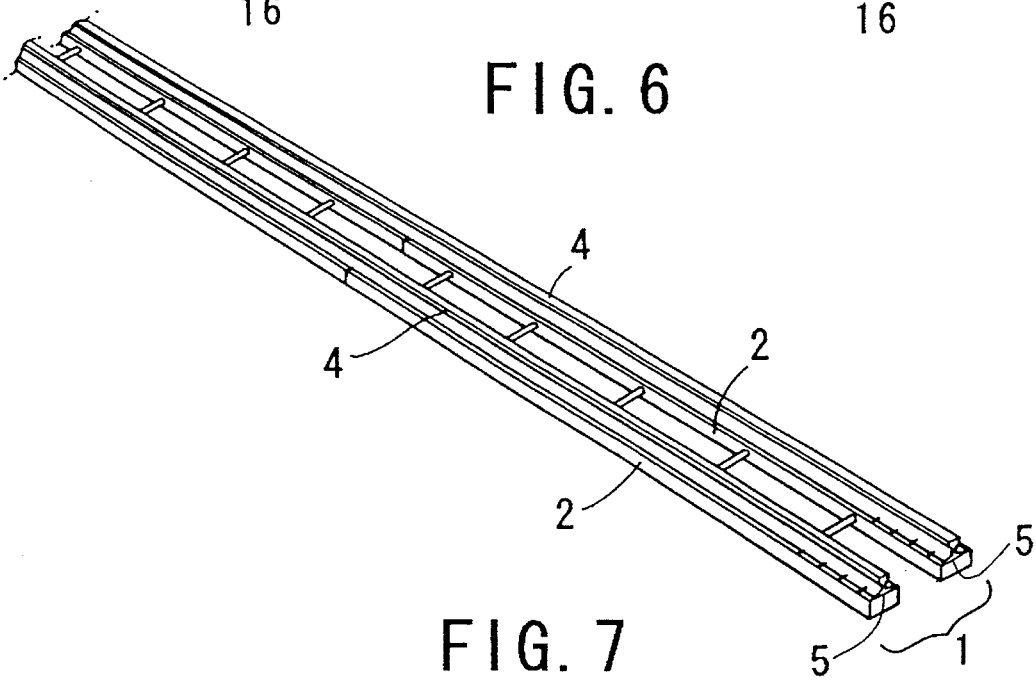
FIG. 6 Compositional diagram showing Embodiment 3 of the present invention, wherein longitudinal beams are mutually bound in the longitudinal direction and the rails are supported by the continuous placement of rail pads, forming continuously uniform tracks over long distances.

FIG. 6 shows Embodiment 3 of the present invention. The ladder-type sleepers have longitudinal beams which are mutually bound in the longitudinal direction, and due to repetition over long distances, the ladder-type sleepers comprise continuous uniform tracks. 1 is a ladder-type sleeper, 2 is a longitudinal beam, 4 is a rail, and 5 is a rail pad.

With the ladder-type sleepers 1 of Embodiment 3, by repeatedly binding longitudinal beams 2 which are adjacent in the longitudinal direction, a continuous and uniform track structure having the combined bending stiffness of the longitudinal beams 2 and the rails 4 is realized.

Furthermore, these sleepers differ from conventional cross-sleepers which only intermittently support the rails 4. Since they are provided with the longitudinal beams 2, continuous support of the rails 4 by the continuous placement of rail pads 5 is possible. Consequently, the tracks comprising the longitudinal beams 2 and the rails 4 have a uniform cross-section, and rolling noise and corrugation of the rails are able to be reduced.

Figure 7:
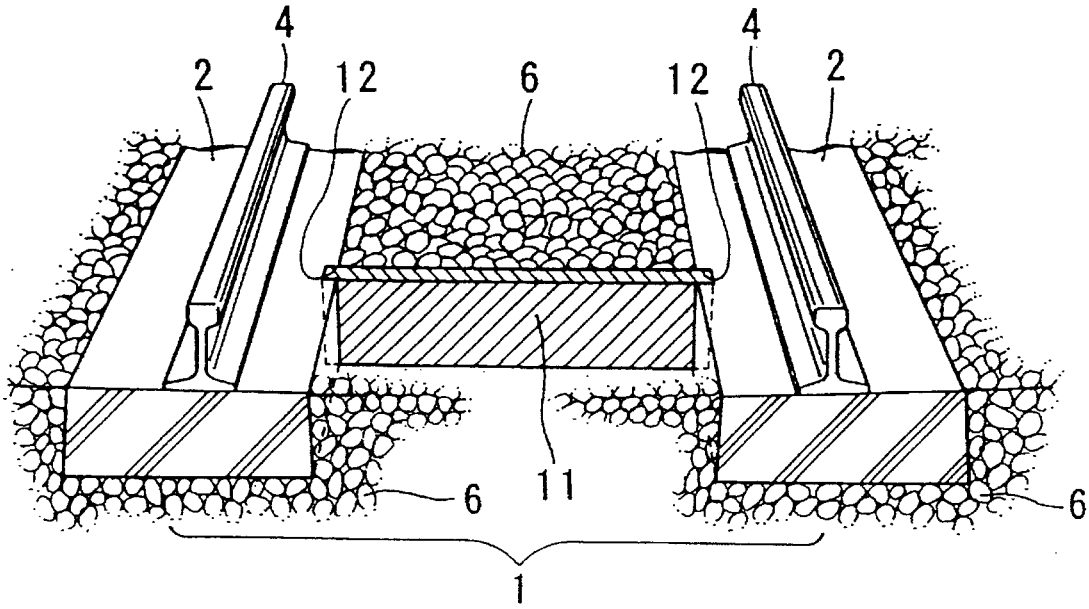
FIG. 7 Compositional diagram showing Embodiment 4 of the present invention, wherein an anti-creep panel is placed between a pair of longitudinal beams comprising the ladder-type sleepers.

FIG. 7 is a compositional diagram of Embodiment 4 of the present invention, wherein anti-creep panels are placed between the pairs of longitudinal beams in the ladder-type sleepers. In this case, 1 is a ladder-type sleeper, 2 is a longitudinal beam, 4 is a rail, 6 is ballast, 11 is an anti-creep panel, and 12 is a groove portion into which the anti-creep panel is inserted.

The sleepers of the present embodiment are made under the assumption that the resistance capacity to the load in the longitudinal direction is insufficient in the movable sections of long welded rails. Groove portions 12 are provided at appropriate intervals on the inside surfaces of the longitudinal beams. The ends of concrete or steel anti-creep panels 11 are inserted into these grooves. As a result, the longitudinal resistance capacity (the resistance capacity for opposing movement in the longitudinal direction in the ballast bed) can be increased. As shown in the diagram, by making the height of the anti-creep panels 11 approximately equal to the height of the longitudinal beams 2, the most longitudinal resistance capacity is attainable. Since the anti-creep panels 11 are simply inserted into the groove portions 12 of the longitudinal beams 2 as mentioned above, they only contribute to increase the longitudinal resistance, and thus, the anti-creep panels 11 do not have any negative effect on the structural properties, such as track stiffness, of the ladder-type sleepers. That is, the pressure distribution in the ballast bed would hardly be influenced by the existence of the anti-creep panels 11.

It is also possible to provide said groove portions 12 at designated intervals in a plurality of locations, and to insert said anti-creep panels 11 into only some of the groove portions 12 depending on the required resistance capacity. In this way, by providing anti-creep panels 11 having heights approximately equal to the heights of the longitudinal beams, low resistance capacities resulting from making the connectors 3 circular or from setting their diameters such that they have the minimum required stiffness and strength values are able to be compensated. Stated differently, because the longitudinal resistance capacity is able to be arbitrarily adjusted by adding anti-creep panels, the longitudinal resistance does not need to be considered in the design of the connectors 3. It is also possible to obtain an even greater resistance capacity by using anti-creep panels which are taller than the height of the longitudinal beams 2. As shown in the diagram, since the groove portions 12 for inserting the anti-creep panels 11 are provided only on the inside surfaces of the longitudinal beams 2, the horizontal cross section of each longitudinal beam becomes assymemtric due to the existence of the groove portions 12. As a result of this assymmetry, there is the possibility that the longitudinal beams 2 could deflect transversely if prestresses are induced, and it is desirable to take the following precautions in order to resolve this problem. That is, it is possible to make the cross section symmetric by providing dummy groove portions on the outside surfaces of the longitudinal beams 2; or alternatively, without changing the cross-sectional shape of the prestressed concrete comprising the longitudinal beams 2, providing grooves identical to the above-mentioned groove portions on jigs protruding from the inside surfaces of the longitudinal beams 2, and inserting the anti-creep panels 11 into these grooves.

Figure 8:
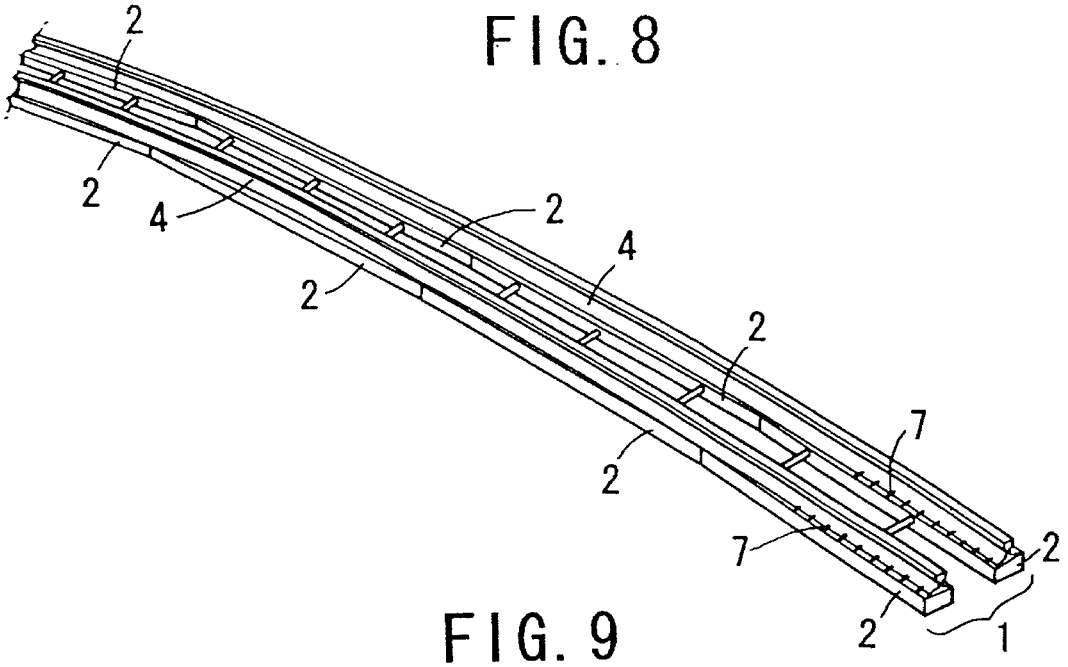
FIG. 8 Compositional diagram showing Embodiment 5 of the present invention, wherein the ladder-type sleepers of the present invention are applied to a curved section of track.

FIG. 8 shows Embodiment 5 of the present invention. In this Embodiment 5, by combining ladder-type sleepers having shorter longitudinal beams with adjustable rail fasteners such as fasteners using tie plates or base plates, they can be applied to curved sections of track. In this case, 1 is a ladder-type sleeper, 2 is a longitudinal beam, 4 is a rail, and 7 is a rail fastener. These sleepers of Embodiment 5 are ladder-type sleepers made from shorter longitudinal beams 2 using adjustable rail fasteners 7. Although the longitudinal beams are straight, it is possible to compose curved sections of the track frame by fitting the sleepers to the curves in a manner similar to that in which the straight sides of a polygon may be fitted to a circle.

Figure 9:
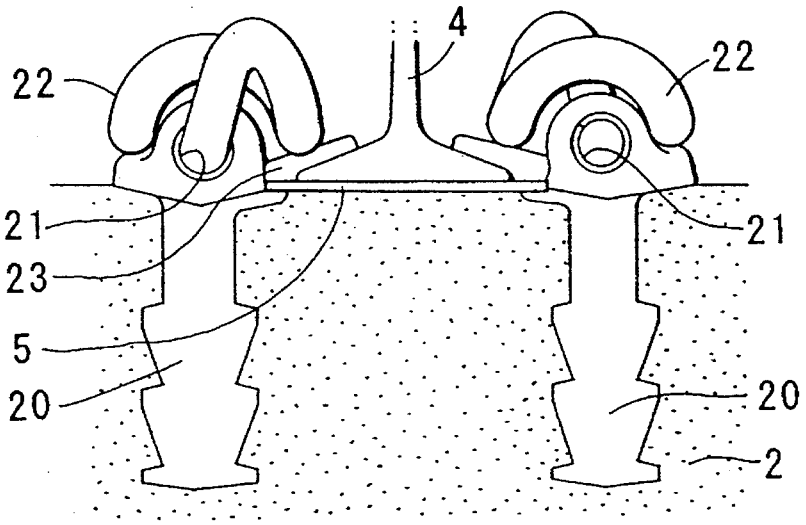
FIG. 9 Cross-sectional diagram showing the composition of the conventional rail fasteners used in FIG. 2.

FIG. 9 shows a detailed example of conventional rail fasteners which are used for the present invention. Inserts 20 are embedded vertically in the concrete beam 2. Support holes 21 are provided approximately parallel to the rail 4 in the inserts 20. Clips 22 are inserted into the support holes 21. Said clips 22 are made to function similar to springs by forming steel rods into the shapes shown. Said clips 22 are attached to the longitudinal beam 2 through said inserts 20 by inserting portions of them into the support holes 21. The rail 4 is pinched and thereby supported between the clips 22 and the longitudinal beam 2. 23 is an insulation material. The inserts 20 of the rail fasteners embedded in the longitudinal beam 2 need to be supported with sufficient capacity. Therefore, the absolute minimum cross-sectional area of the longitudinal beam 2 is determined by the minimum concrete cover needed to bear the fastening force of the inserts 20, and the distance between each pair of rail fasteners determined based on the width of the rails 4.

Figure 10:
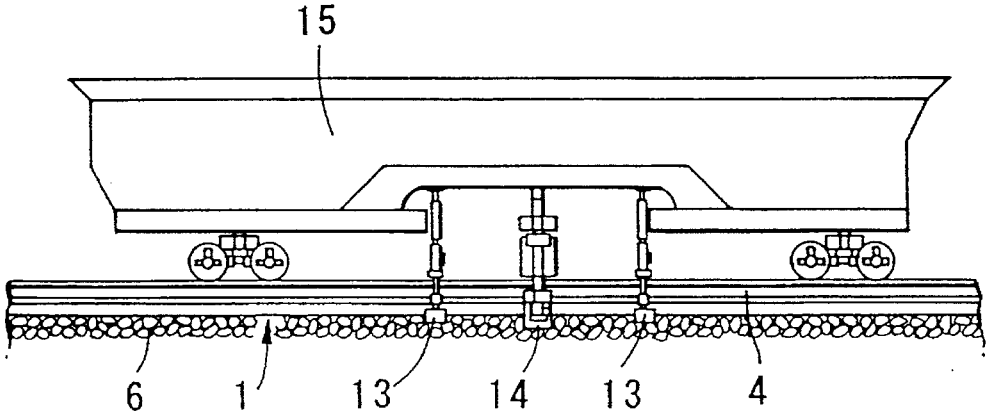
FIG. 10 Explanatory diagram showing Embodiment 6 of the present invention, in the case in which track maintenance work is carried out by lifting the track frame with a maintenance machine.
Figure 11:
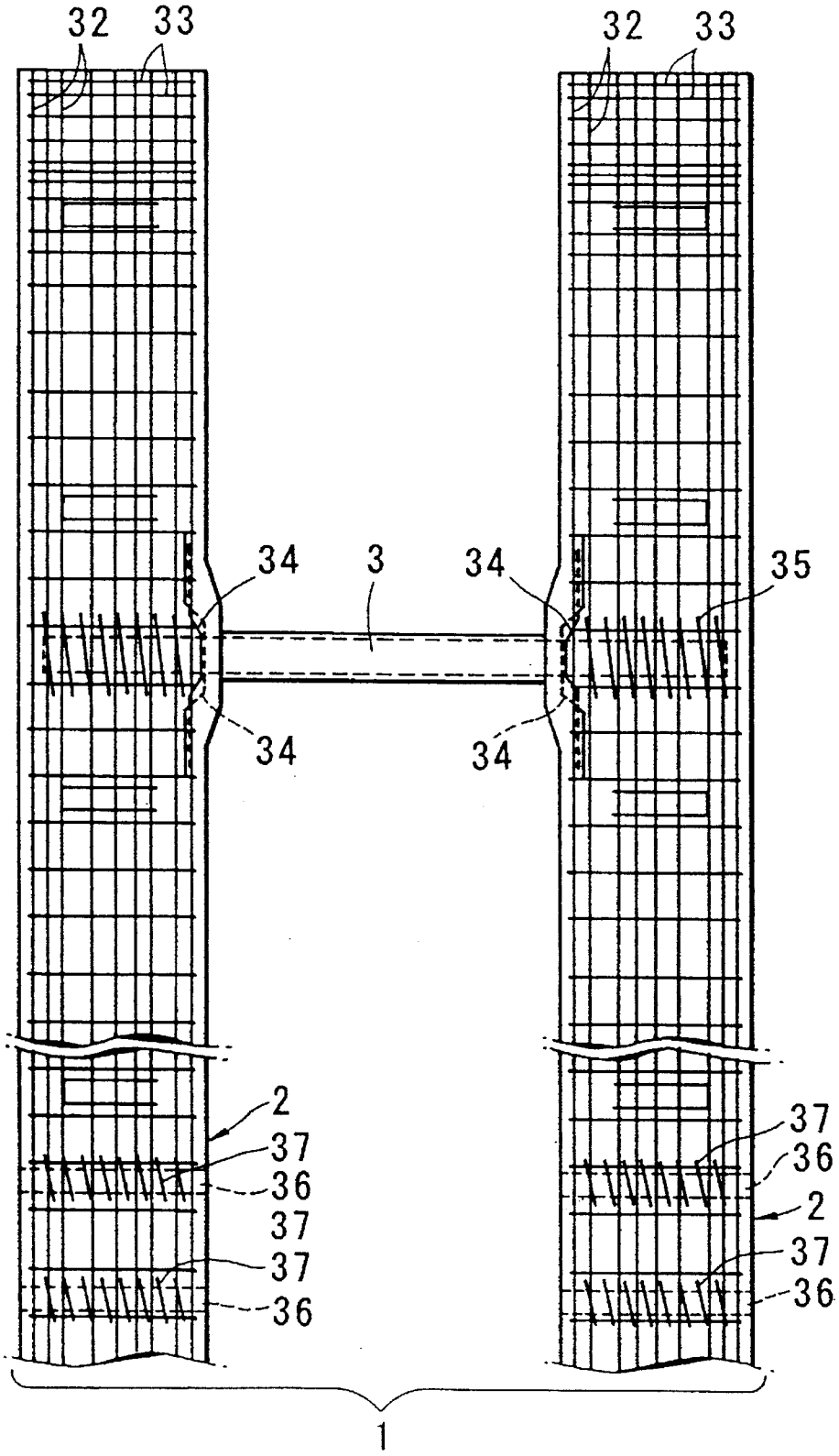
FIG. 11 Plan view showing Embodiment 7 of the present invention, showing the placement of steel reinforcements within the ladder-type sleepers.
Figure 12:
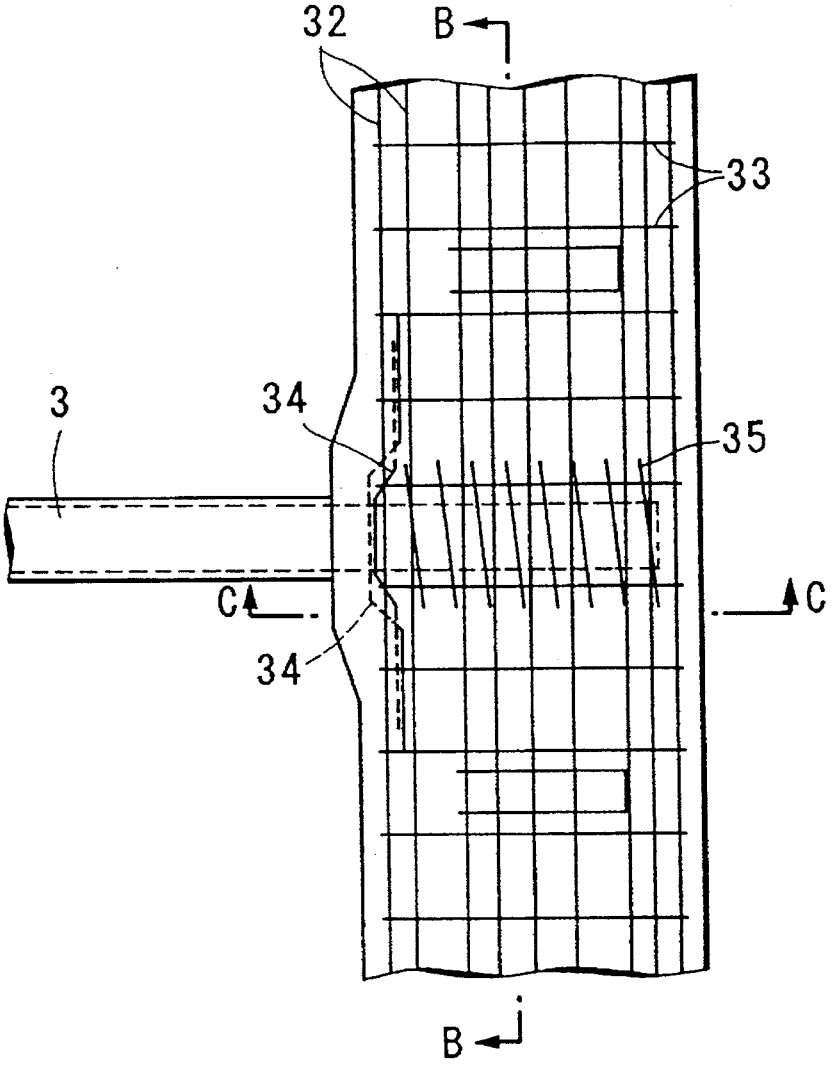
FIG. 12 Enlarged view of the connecting portion of the connectors in FIG. 11.
Figure 13:
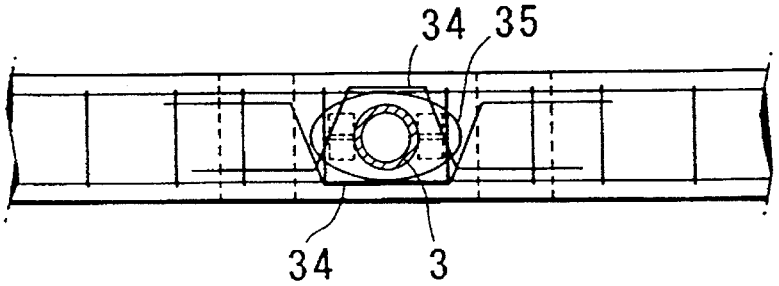
FIG. 13 Cross-sectional diagram cut along B—B in FIG. 12.
Figure 14:
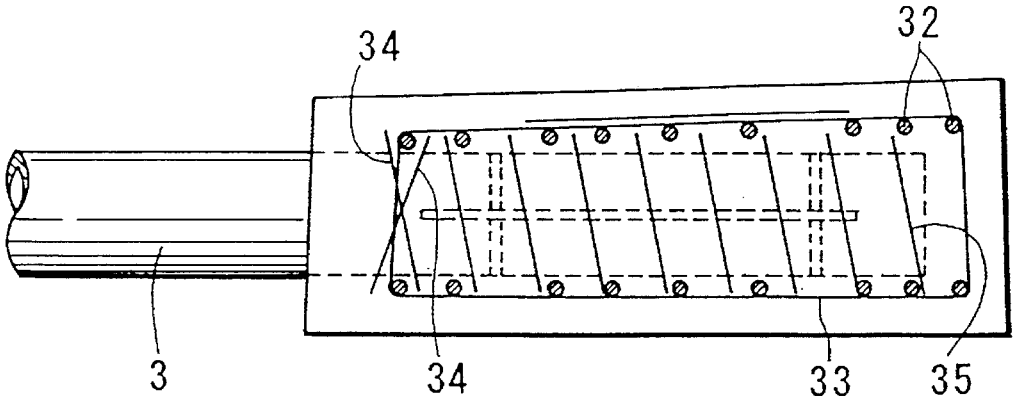
FIG. 14 Cross-sectional diagram cut along C—C in FIG. 12.

FIG. 10 is a diagram explaining the maintenance work procedure for the ladder-type sleepers of the present invention, performed by lifting the tracks with a maintenance machine. In this case, 1 is a ladder-type sleeper, 4 is a rail, 6 is ballast, 13 is a track lifting apparatus, 14 is either a tamping apparatus or a blowing apparatus for fine crushed stone, and 15 is a track maintenance machine.

With conventional cross-sleepers, the bending stiffness of the track about the transverse axis is dependent only upon the rails 4 because the sleepers are placed only intermittently. As a result, the track structure has a low bending stiffness. The tracks using longitudinal beams of the present invention have a track structure with relatively high bending stiffness because the bending stiffness of the rails 4 and the longitudinal beams are added together. For ballasted tracks, track maintenance is usually performed by a ballast tamping procedure using mechanical power such as that of multiple tie tampers. Tamping is performed by lifting the track frame by approximately 3 cm. However, if the bending stiffness of the track becomes too large, then it becomes difficult for a maintenance machine to lift up the entire track frame. With the present invention, by giving the longitudinal beams 2 the absolute minimum cross-sectional area, the stiffness of the combination of the longitudinal beams 2 and the rails 4 is set at an appropriate minimum. Therefore the overall track structure has the most suitable degree of bending stiffness. As a result, it is possible to perform track maintenance work in the conventional way, by lifting the sleepers with a track maintenance machine 15 and tamping the ballast, blowing in fine crushed stone, or injecting mortar.

FIGS. 11 through 15 show Embodiment 7 relating to the structure of the connecting portions of the longitudinal beams 2 and the connectors 3.

The connectors 3 are made from steel pipes having approximately the same length as the width of the ladder-type sleepers 1 subtracted by the necessary concrete cover on both sides. Within the longitudinal beams 2, a plurality of mutually parallel prestressing strands 32 are provided in the longitudinal direction. First reinforcing bars 33 are provided in the direction perpendicular to these prestressing strands 32. In the vicinity of said connectors 3, second reinforcing bars 34 are provided in addition to the prestressing strands 32 and the first reinforcing bars 33 in order to increase the coupling strength between the connectors 3 and the nearby concrete. Said second reinforcing bars 34 are formed into a crooked shape so as to surround the connectors 3 from their tops to their bottoms. In the portions in which said connectors 3 are embedded in the longitudinal beams 2, spiral-shaped reinforcing bars 35 are provided, in order to ensure the coupling strength between the connectors 3 and the nearby concrete. In the longitudinal beams 2, pipes 36 are embedded in order to allow insertion of cables and the like. Around these pipes 36, spiral-shaped reinforcing bars 37 are provided in order to increase the coupling strength with the concrete.

Figure 15:
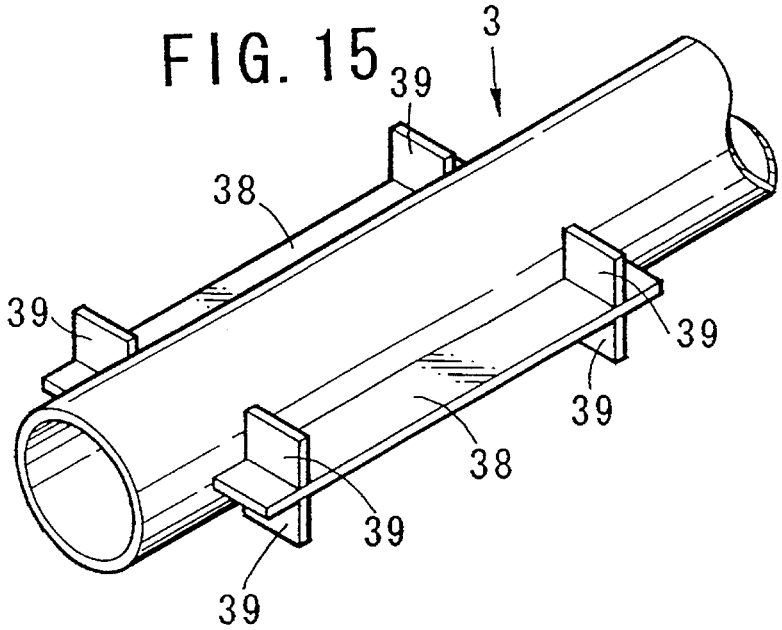
FIG. 15 Perspective view showing the outward appearance of the connectors in FIG. 11.
Figure 16:
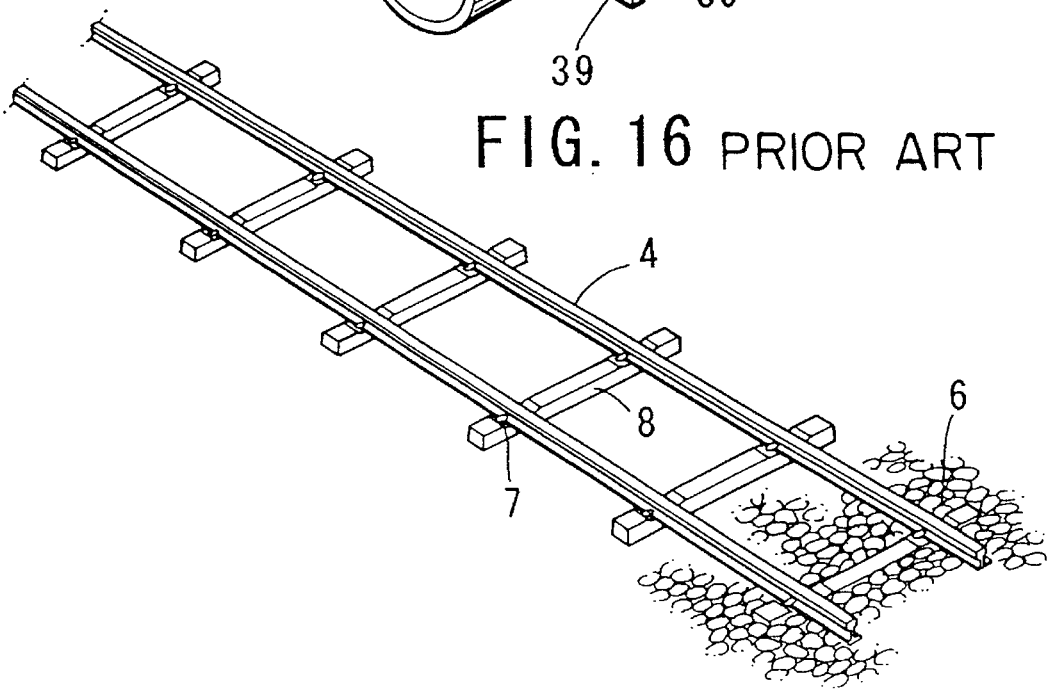
FIG. 16 PRIOR ART
FIG. 16 Compositional diagram of conventional ballasted track structure using cross-sleepers.

Said connectors 3 have a structure as shown in FIG. 15. On both sides of each connector 3, ribs 38, which protrude in the radial direction and transmit the rotational force of the connector 3 into the concrete, are provided. Small ribs 39 are also provided on the upper and lower surfaces of these ribs 38 in order to transmit the force in the transverse direction from the connector 3 to the concrete. Inserts 20 of rail fasteners 7 as shown in FIG. 9 are embedded in the longitudinal beams 2 so as to avoid the positions of said connectors 3. St is also an effective measure to place reinforcing bars around these inserts in a spiraling fashion to increase the coupling strength between the inserts and the concrete. Regarding the inserts (specifically, cylinders having threaded holes) used for binding the longitudinal beam 2 to another adjacent longitudinal beam, it is also desirable to place reinforcing bars around these inserts in a spiraling fashion in order to increase the coupling strength between these inserts and the concrete. As for the lengths of these longitudinal beams 2, the ease with which they are able to be transported to construction sites needs to be considered. Accordingly, they could be set at 12.5 meters, but are not necessarily restricted to such a value. Additionally, the spacing between the inserts (rail fastenings), for example, could be set at approximately 0.6 meters, and the spacing between the connectors 3 could be set at about 2.5 meters, but they are not necessarily restricted to these values.

Additionally, in the above embodiments, the capacity in any direction at the connecting section between the connector 3 and the longitudinal beam 2 was made uniform by using a connector made from a pipe having a circular cross-section. However, angular pipes, or any other cross-sectional shape may be used to increase the capacity in any desired direction.

We claim:

1. Ladder-type sleepers comprising:

a pair of longitudinal beams of a first material configured to be provided underneath a pair of rails, such that each one of said pair of longitudinal beams will be provided underneath a corresponding rail along a longitudinal direction thereof; and a plurality of connectors coupling said longitudinal beams at a set spacing in the longitudinal direction of the rails, wherein said connectors comprise conduits of a second material that is more flexible than said first material, and each said connector is a single continuous member having first and second ends rigidly embedded in said longitudinal beams.

2. Ladder-type sleepers according to claim 1, wherein the cross section of said connectors is in the shape of a circle having a radius less than the height of said longitudinal beams.

3. Ladder-type sleepers according to claim 2, wherein anti-creep panels being approximately equal in height to said longitudinal beams are provided between said pair of longitudinal beams at positions spaced from said connectors.

4. Ladder-type sleepers according to claim 3, further comprising fasteners for fastening the rails to said longitudinal beams, wherein said longitudinal beams have a minimum cross-sectional area determined according to an embedding depth, concrete cover, and distance between each said fastener when the rail is connected to said beam.

5. Ladder-type sleepers according to claim 3, wherein grooves for inserting end portions of said anti-creep panels am provided in the vertical direction on the inside surfaces of said pair of longitudinal beams.

6. Ladder-type sleepers according to claim 5, wherein said longitudinal beams comprise prestressed concrete having reinforcements, and said connectors are long enough to intersect with the reinforcements inside said longitudinal beams.

7. Ladder-type sleepers according to claim 6, wherein longitudinal beams repeating in the longitudinal direction are mutually bound.

8. Ladder-type sleepers according to claim 1, further comprising fasteners for fastening the rails to said longitudinal beams, wherein said longitudinal beams have a minimum cross-sectional area determined according to an embedding depth, concrete cover, and distance between each said fastener when the rail is connected to said beam.

9. Ladder-type sleepers according to claim 1, wherein said longitudinal beams are configured to be coupled to the rails in a plurality of locations along the longitudinal direction of the rails.

10. Ladder-type sleepers according to claim 9, wherein anti-creep panels being approximately equal in height to said longitudinal beams are provided between said pair of longitudinal beams at positions spaced from said connectors.

11. Ladder-type sleepers according to claim 10, wherein grooves for inserting end portions of said anti-creep panels are provided in the vertical direction on the inside surfaces of said pair of longitudinal beams.

12. Ladder-type sleepers according to claim 1, wherein the conduits have a circular cross-section.

13. Ladder-type sleepers according to claim 1, wherein the conduits have an angled cross-section.

14. Ladder-type sleepers according to claim 1, wherein the conduits have an H-shaped cross-section.

15. Ladder-type sleepers according to claim 1, wherein the conduits have a C-shaped cross-section.

16. Ladder-type sleepers according to claim 1, wherein anti-creep panels being approximately equal in height to said longitudinal beams are provided between said pair of longitudinal beams at positions spaced from said connectors.

17. Ladder-type sleepers according to claim 16, wherein grooves for inserting end portions of said anti-creep panels are provided in the vertical direction on the inside surfaces of said pair of longitudinal beams.

18. Ladder-type sleepers according to claims 17, 11, or 5, further comprising grooves provided in the vertical direction on the outside surfaces of said pair of longitudinal beams opposite said grooves on said inside surfaces.

19. Railway tracks comprising:

a pair of longitudinal beams of a first material, disposed generally parallel to one another;

a pair of rails, each rail attached to an upper surface of a corresponding beam; and a plurality of connectors coupling said longitudinal beams at a set spacing, wherein said connectors comprise conduits of a second material that is more flexible than said first material, and each said connector is a single continuous member having first and second ends rigidly embedded in said longitudinal beams.

20. Railway tracks according to claim 19, wherein anti-creep panels being approximately equal in height to said longitudinal beams are provided between said pair of longitudinal beams.

21. Railway tracks according to claim 20, wherein grooves for inserting end portions of said anti-creep panels are provided in the vertical direction on the inside surfaces of said pair of longitudinal beams.

22. Railway tracks according to claim 21, further comprising grooves provided in the vertical direction on the outside surfaces of said pair of longitudinal beams opposite said grooves on said inside surfaces.

23. Ladder-type sleepers comprising:

a pair of longitudinal beams configured to be provided underneath a pair of rails such that each one of said pair of longitudinal beams will be provided underneath a corresponding rail along a longitudinal direction thereof; and a plurality of connectors coupling said longitudinal beams at a set spacing, wherein said connectors comprise conduits and have a flexibility greater than a flexibility of said longitudinal beams, and each said connector is a single continuous member having first and second ends rigidly embedded in said pair of longitudinal beams, respectively.

24. Ladder-type sleepers according to claims 1 or 23, wherein said connectors include means for transmitting a rotational force from said connectors into said longitudinal beams.

25. Ladder-type sleepers according to claims 1 or 23, wherein said longitudinal beams include means for increasing a coupling strength between said longitudinal beams and said connectors.

26. Railway tracks comprising:

a pair of longitudinal beams, disposed generally parallel to one another;

a pair of rails, each rail attached to an upper surface of a corresponding beam; and a plurality of connectors coupling said longitudinal beams at a set spacing, wherein said connectors comprise conduits and have a flexibility greater than a flexibility of said longitudinal beams, and each said connector is a single continuous member having first and second ends rigidly embedded in said pair of longitudinal beams, respectively.

27. Railway tracks according to claims 19 or 26, wherein said longitudinal beams include means for increasing a coupling strength between said longitudinal beams and said connectors.

28. Railway tracks according to claims 19 or 26, wherein said connectors include means for transmitting a rotational force from said connectors into said longitudinal beams.

* * * * *

UNITED STATES PATENT AND TRADEMARK OFFICE

CERTIFICATE OF CORRECTION

PATENT NO. : 5,582,346

DATED : December 10, 1996

INVENTOR(S) : Hajime Wakui et al.

It is certified that error appears in the above-indentified patent and that said Letters Patent is hereby corrected as shown below:

Claim 5, column 9, line 56, "am" should read --are--.

Signed and Sealed this

First Day of July, 1997

Bruce Lehman

*Attest:*

BRUCE LEHMAN

*Attesting Officer*

*Commissioner of Patents and Trademarks*